US005285726A

United States Patent [19]

Ohta

[11] Patent Number: 5,285,726

[45] Date of Patent: Feb. 15, 1994

[54] OFFSET ROTARY FOR COLOR PRINTING SYSTEM

[75] Inventor: Hideo Ohta, Tokyo, Japan

[73] Assignee: Kabushikigaisha Tokyo Kikai Seisakusho, Tokyo, Japan

[21] Appl. No.: 889,907

[22] Filed: May 29, 1992

[30] Foreign Application Priority Data

Nov. 15, 1991 [JP] Japan ..... 3-328077

[51] Int. Cl.[5] ..... B41F 13/54

[52] U.S. Cl. ..... 101/228; 101/181; 101/DIG. 42

[58] Field of Search ..... 101/180, 228, 181, 183, 101/232, DIG. 42; 226/196, 197; 400/613.3, 618

[56] References Cited

U.S. PATENT DOCUMENTS 4,335,857 6/1982 Pfost et al. ..... 226/196

4,404,906 9/1983 Curran ..... 101/180

OTHER PUBLICATIONS

IFRA Newspaper Techniques English Edition, published by INCA-FIEJ Research Association, pp. 64-73, Apr. 1988.

*Primary Examiner*—Edgar S. Burr
*Assistant Examiner*—Ren Yan
*Attorney, Agent, or Firm*—Foley & Lardner

[57] ABSTRACT

This invention relates to an offset type rotary press adapted for a color printing system, with printing sections, which prevents print-shears and produces printed matter in high quality. The system of this invention includes an extending area, which supplies to the travelling paper web the power to extend in the width direction, and at least two printing sections arranged in sequence at the position where the paper web travels after passing through the extending area.

7 Claims, 5 Drawing Sheets

OFFSET ROTARY FOR COLOR PRINTING SYSTEM

BACKGROUND OF THE INVENTION

1. Field of the Invention

The present invention is generally related to an offset (planograph) type rotary press, more particularly to an offset rotary press adapted for a color printing system including at least two printing sections which can sequentially and continuously print a paper-web travelling through the printing sections.

2. Description of the Prior Art

A typical conventional offset rotary press adapted for a color printing system is shown in FIG. 7. This conventional rotary press printing system comprises a plurality of printing sections P, each of which includes two pairs of a combination of a plate cylinder PC and a blanket cylinder BC. The blanket cylinders BC of each printing section P are vertically arranged to be in contact with each other. In this conventional printing system, four sets of the printing sections P are horizontally arranged in parallel. A paper web W is horizontally fed into the four sets so that the paper web W travels through the pressed space between four pairs of the blanket cylinders BC, BC to print both surfaces of the paper web W.

Another conventional offset rotary press for a color printing system is shown in FIG. 8 wherein four printing sets, each of which is composed of a plate cylinder PC and a blanket cylinder BC, are radially arranged about an impression cylinder IC as a common center cylinder. The blanket cylinder BC is in contact with the impression cylinder IC to form the printing section P. A paper web W travels around the circumference of the impression cylinder IC so that the paper web W is passed through the four printing sections P defined between the blanket cylinders BC and the impression cylinder IC to print one surface of the paper web W.

In recent years, many newspaper publishers have begun to print their publications with colored inks, thus demanding high performance color printing on many pages at a high speed and within a limited printing space.

According to such demands, other conventional offset rotary press color printing systems are shown in FIG. 9 and FIG. 10, wherein four printing sections P are vertically arranged. Each printing section P includes two sets of a blanket cylinder BC and a plate cylinder PC which are symmetrically arranged so as to bring the blanket cylinders BC into contact with each other. A paper web W vertically travels through the four printing sections P to print both surfaces of the paper web W in the same manner as the system described above. This type of printing system, for example, is shown in "IFRA Newspaper Techniques English Edition", pp. 64 to pp. 79; April, 1988, published by INCA-FIEJ Research Association.

The paper web to be printed is generally produced in such a manner that pulp fibers are mechanically out and broken into fine particles; dispersed in water; dehydrated and dried; and finally adhered by hydrogen-bond to form a paper sheet. Under moist conditions, each of the pulp fibers tends to extend a little less than 1 percent in its longitudinal direction and 20 to 30 percent in its radius direction. Thus the paper web is extended in its longitudinal and width directions by the dampening operation. Most of the pulp fibers of general mechanically produced paper web are orientated in the longitudinal direction of the paper web, so that the paper web is remarkably extended in its width direction.

In the offset type printing system employing the dampening procedure in the printing section, the paper web is caused to swell by the dampening water. Therefore, the printed pattern on the paper web is also deformed in response to the swell of the paper web. Even when the printing systems that include at least two continuous printing sections employ the dampening means applying water vapor to the paper web, the printed image formed at the first printing section does not correctly coincide with the image formed at the second and later printing sections. Accordingly, this will produce printed materials of poor quality.

BRIEF SUMMARY OF THE INVENTION

Therefore, it is a primary object of the invention to provide an improved offset type rotary press adapted for color printing which can produce high quality printed materials without sheers of images caused by the enlargement of paper web due to water.

The features of the invention will be apparent in the following description of the disclosure found in the accompanying drawings and the novelty thereof pointed out in the appended claims.

DETAILED DESCRIPTION OF THE PREFERRED EMBODIMENT

One preferred embodiment of the present invention will be described in detail with reference to the accompanying drawings, in FIGS. 1 to 8.

Figure 1:
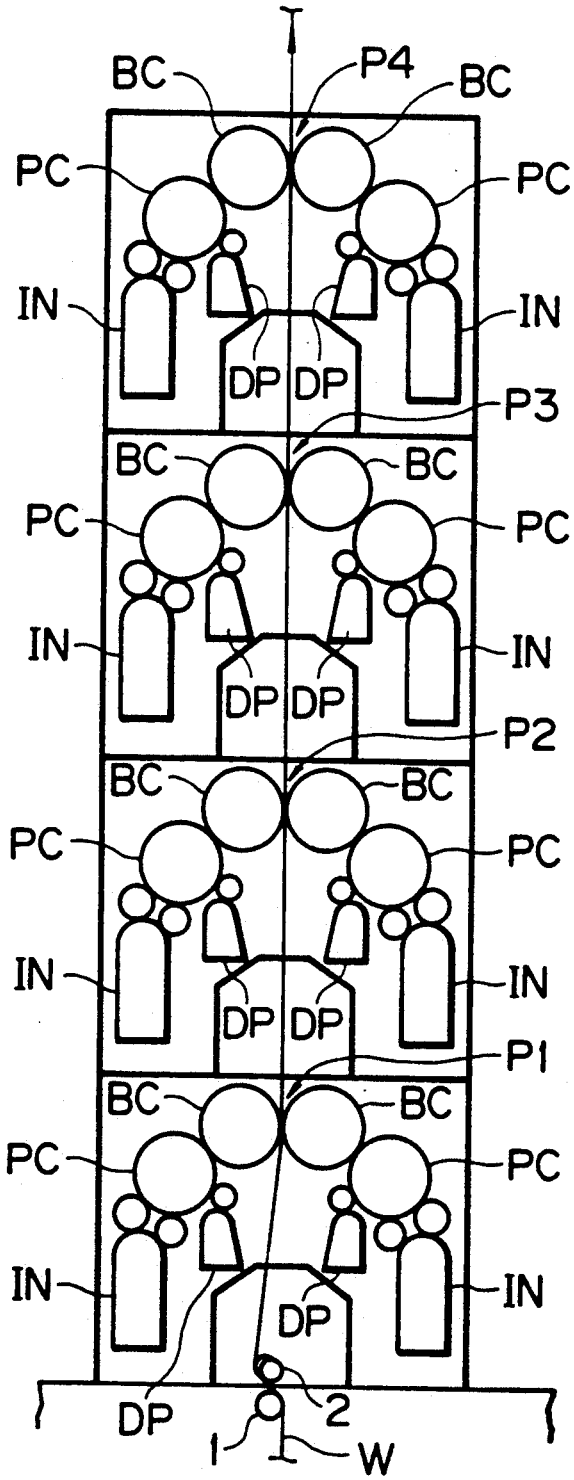
FIG. 1 is a schematic elevational view showing an overall constitution of the offset type color-printing rotary press printing system according to the present invention.
Figure 10:
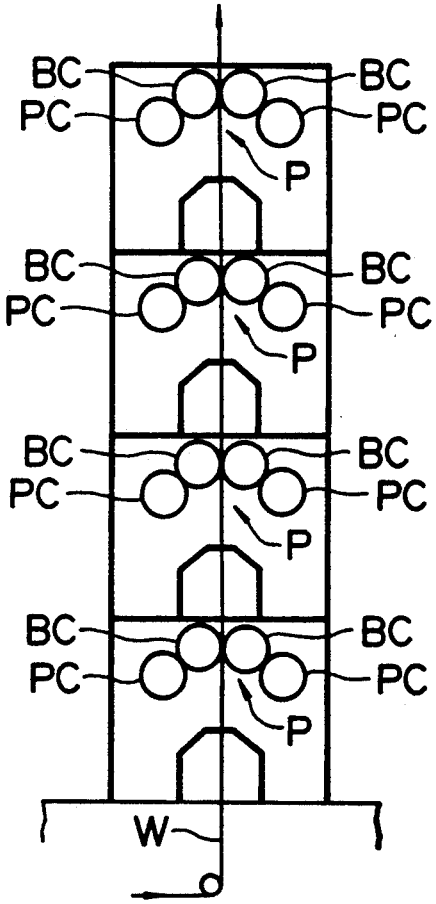
FIG. 10 PRIOR ART

In FIG. 1, there is shown an overall constitution of the offset type color-printing rotary press printing system which comprises four printing sections P1, P2, P3 and P4 vertically arranged in the same manner as the conventional color-printing rotary press printing system described above and shown in FIG. 10. Each printing section includes two sets of a blanket cylinder BC and a plate cylinder PC which are symmetrically arranged so as to bring the blanket cylinders BC into contact with each other. A paper web W travels vertically from the first printing section P1 to the fourth printing section P4. Upstream of the first printing section P1, P2, P3, P4, extending means 1, 2 is arranged.

Figure 2:
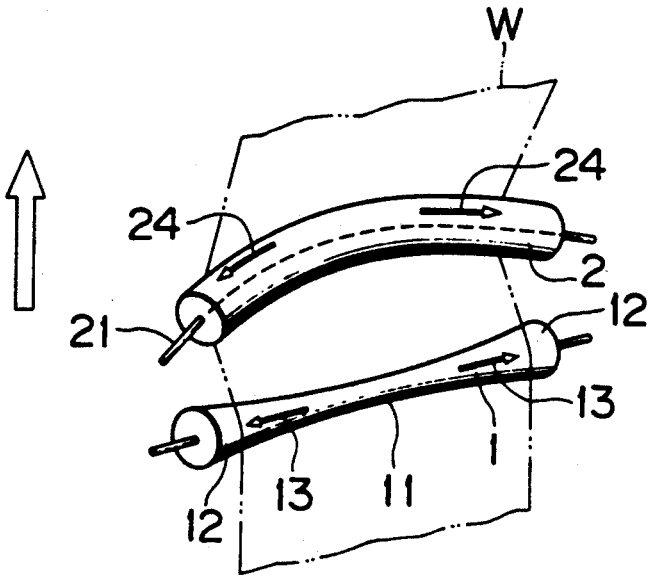
FIG. 2 is a schematic perspective view showing an overall constitution of the extending means shown in FIG. 1.
Figure 3:
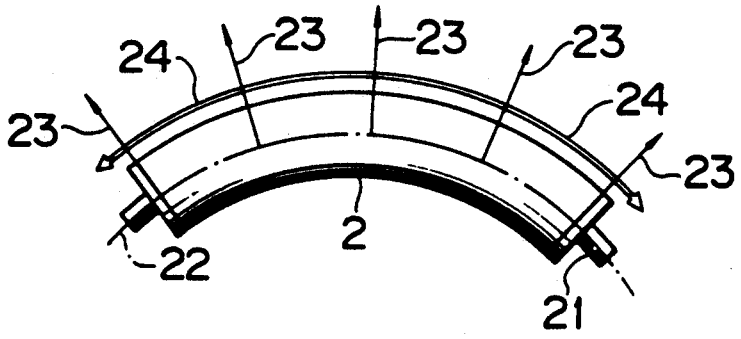
FIG. 3 is an explanatory view showing the power of the expander roller pressed onto the paper web.

Extending means 1, 2 shown in FIG. 1 consists of a concave crown roller 1, the circumferential surface of which is set in contact with the one side of the paper web W as shown in FIG. 2, and of a so-called expander roller 2, revolving around the curved axis 21, the convex circumferential surface of which is arranged in contact with the other surface of the paper web W, opposite to the surface contacting the concave crown roller.

Figure 4:
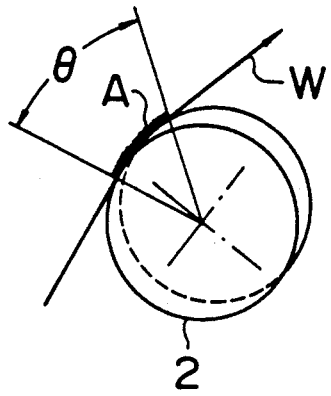
FIG. 4, FIG. 5 and FIG. 6 are views showing the position of the axis of the expander roller, the change of the contacting angle of the paper web and the contacting position thereof.
Figure 5:
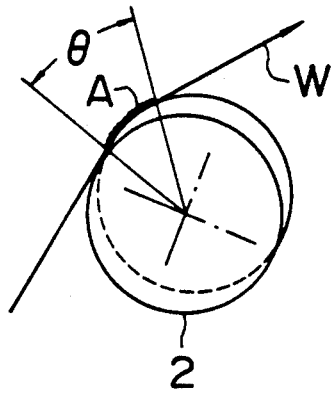
Figure 6:
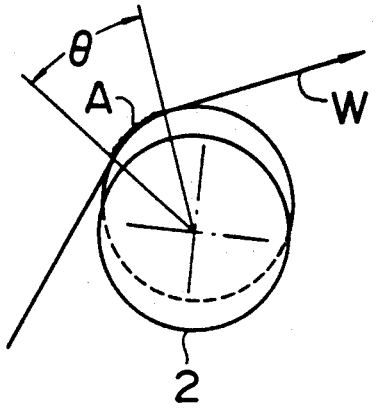
Figure 7:
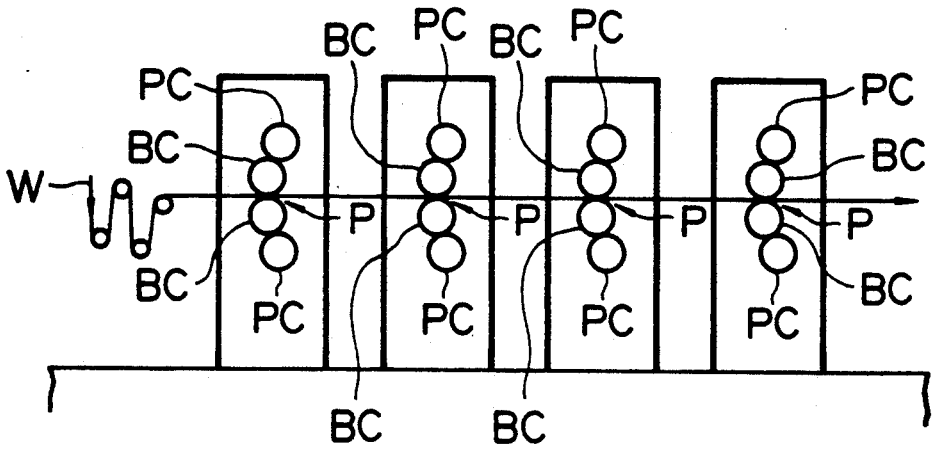
FIG. 7 PRIOR ART
FIG. 7, FIG. 8, FIG. 9 and FIG. 10 are conventional configurations.
Figure 8:
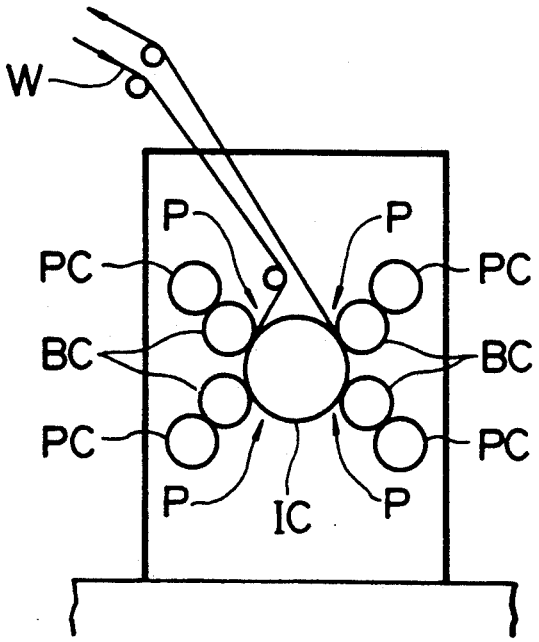
FIG. 8 PRIOR ART
Figure 9:
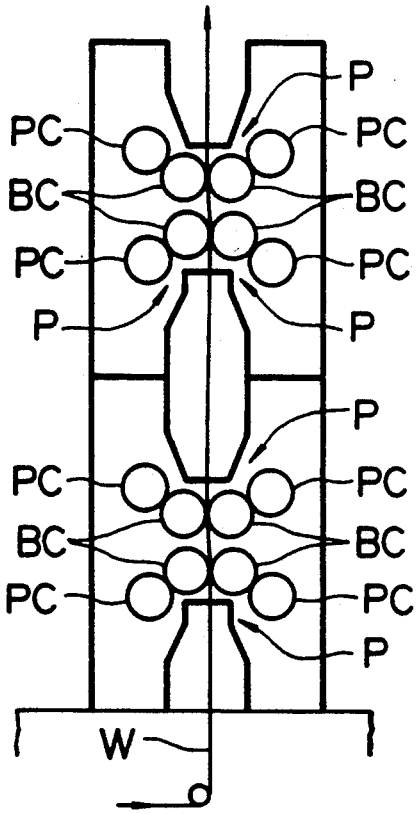
FIG. 9 PRIOR ART

The expander roller 2 can change the angle $\theta$ contacting the paper web W and the contacting position A (FIG. 4, FIG. 5 and FIG. 6) by changing the place where the curved axis 21 is set, and can change the power extending the paper web W in the width direction, by changing the contacting angle $\theta$ and the contacting position A. FIGS. 4–6 illustrate some variations in the contact angle not exceeding 45°.

In FIG. 1, IN and DP represent an inking unit and a dampening unit, respectively.

Accordingly, the paper web W is supplied to the web travelling line, and succeedingly set through the first, second, third and fourth printing sections P1, P2, P3 and P4 in sequence. Then the printing system is started in order to cause the paper web W to travel and drive the printing sections P1, P2, P3 and P4.

The paper web W, which is operated by the printing system, contacts the circumferential surface of the concaved crown roller 1, and is elastically transformed by extending in the width direction, by the power 13 which is caused by the difference of the travelling speed of the central part of roller 11 and the end part of the roller 12. This difference is brought about by the shape of the concave crown roller 1. Additionally, the paper web W contacts the convex circumferential surface of the expander roller 2 and is elastically transformed by extending in the width direction pressed by the power 24 which is caused by the difference of the travelling direction of the paper web W brought about by the shape of the expander roller 2. That is, the power 24 is produced by the power 23 which makes the paper web W travel at right angle to the arc 22, an axial line of the expander roller 2.

The paper web W which is elastically transformed by the full extension in the width direction is restored gradually to its transformed width during the time it travels from through the expander roller 2 to reaching the printing section P1. Before completely restoring its transformation of the paper web W, it reaches the printing section P1 and the first image is printed and the dampening water is supplied through the blanket surface of the blanket cylinder BC from the non-image area of the plate.

The paper web W, which is supplied with the dampening water, enlarges its width direction by the fibre absorbing water, and travels towards the printing section P2 from P1. Meanwhile, the elastic transformation in the width direction is completely restored during the travelling time. Accordingly, the length of the paper web W is to be stabilized through the offset of the enlargement in the width direction by water supply and the restoration of the elastic transformation.

In other words, when the extension in the width direction is appropriately determined, the width of the paper web W travelling toward the printing section P2 from the printing section P1 can be stabilized as it is when the printing is done in the printing section P1.

The enlargement of the width by a water supply will be further enlarged by a first water supply, but is scarcely enlarged by the further water supply.

Thus, the second to the fourth printed image is printed on the paper web W, which moves through the printing section P2 up to P4 in sequence after travelling the length of the printing section P1, and the image completely coincides with the image formerly printed.

In practicing this invention, succeeding printing is done after the width of the paper web is stabilized as it is in the first printing, even when continuous printing onto the same paper web is made by at least 2 printing sections utilizing the dampening water. Such printing is realized by producing elastic transformation extending the paper web in the width direction before reaching the first printing section, and then restoring the elastic transformation, offsetting the enlargement caused by absorbing water. As many apparently widely different embodiments of this invention may be made without departing from the spirit and scope thereof, it is to be understood that the invention is not limited to the specific embodiments thereof except as defined in the appended claims.

What is claimed is:

1. An offset type color-printing rotary press for printing an image on a web without shearing, comprising:

(a) a plurality of printing sections including a first printing section;

(b) a concave crown roller having a concave circumferential surface arranged to contact one side of the web travelling through the press; and (c) an expander roller with a curved axis having a convex circumferential surface arranged to contact an other side of the web travelling through the press;

wherein the crown roller and expander roller are positioned vertically below the first printing section, and the crown roller is positioned vertically below the expander roller.

2. An offset type color-printing rotary press as in claim 1, wherein the printing sections include at least two sets of a blanket cylinder and a plate cylinder, the blanket cylinders arranged to contact each other.

3. An offset type color-printing rotary press as claimed in claim 2, wherein the printing sections are vertically arranged.

4. An offset type color-printing rotary press as claimed in claim 3, wherein there are four printing sections.

5. An offset type color-printing rotary press as claimed in claim 1, wherein a curvature of the curved axis of the expander roller may be modified.

6. An offset type color-printing rotary press as claimed in claim 1, wherein the printing sections include a dampening unit.

7. An offset type color-printing rotary press as in claim 1, wherein the crown roller and expander roller are vertically positioned at a distance from each other and from the first printing section, so that a contact angle of a web travelling over the rollers is less than 45°.

* * * * *